US005664673A

United States Patent [19]

Perry

[11] Patent Number: 5,664,673

[45] Date of Patent: Sep. 9, 1997

[54] STORAGE BAND FOR A VIDEO MONITOR

[76] Inventor: Irvin Gene Perry, 521 Grand Ave., Colton, Calif. 92324

[21] Appl. No.: 675,249

[22] Filed: Jul. 1, 1996

[51] Int. Cl.[6] ..... B65D 85/28

[52] U.S. Cl. ..... 206/371; 211/69.1; 248/205.2; 248/918

[58] Field of Search ..... 206/371, 224, 206/320, 305, 214; 248/205.2, 442.2, 918; 211/50, 69.1; 383/39

[56] References Cited

U.S. PATENT DOCUMENTS

| | | | |
|---|---|---|---|
| 5,002,401 | 3/1991 | Blackman | 383/39 |
| 5,125,516 | 6/1992 | McKenna | 248/205.2 |
| 5,366,070 | 11/1994 | Wolov | 206/371 |

*Primary Examiner*—Bryon P. Gehman
*Assistant Examiner*—Nhan T. Lam
*Attorney, Agent, or Firm*—Gene Scott-Patent Law and Venture Group

[57] ABSTRACT

A storage device for a video monitor includes a belt stretched around the top, sides and bottom of the monitor. The outfacing surface of the belt has a loose knap so that it may be engaged by a Velcro® hook type material. Two side plates are mounted by this method of fastening to the belt along the sides of the monitor. The side plates provide outfacing pockets for storing pencils, markers and even a few small floppy disks. A front plate stretches across the front of the monitor cabinet, either above or below the viewing screen and also attaches to the belt along the sides of the monitor. The front plate also includes at least one pocket for conveniently holding further objects useful to a person using the monitor.

4 Claims, 2 Drawing Sheets

STORAGE BAND FOR A VIDEO MONITOR

BACKGROUND OF THE INVENTION

1. Field of the Invention

This invention relates generally to simple storage devices for storing small items on a video monitor, and more particularly to such a storage device for use on the outside surfaces of a video monitor.

2. Description of Related Art

Invention and use of devices in the field of the invention is known to the public, as they are used for the intended purposes as defined herein. The following art defines the current state of this field:

Rose, Jr., U.S. Pat. No. 4,957,205 shows a computer disk holder for disks of the 3½ inch format attachable to a three-ring notebook with snap rings. The disk holder includes a frame of relatively rigid plastic having tabs formed along an edge so that the disk holder can function as a page flipper for documentation when connected into the notebook. Disks are inserted into the disk holder along guide means and received by retention means.

Auerbach, U.S. Pat. No. 4,958,737 shows an accessory tray which can be placed atop a computer monitor regardless of the monitor's size and shape. The underside of the tray has a rubber friction pad attached near its front, and a bendable wire attached near its rear by means of tubes welded to the underside. The wire is bent to hold the rear of the tray spaced from the top of the monitor so that the tray will not block any air vents. The friction pad, and a soft plastic sleeve over the portion of the wire that contacts the top of the monitor, enable the tray to resist slipping. Options such as a copy holder and a static electricity grounding connection are also attachable to the underside of the tray.

Husta, U.S. Pat. No. 5,098,128 shows a holder for a loose-leaf pad that is adapted to be mounted to a computer monitor or similar device. The holder is mounted to either the left or right vertical side of the monitor or to a horizontal surface such as the monitor top. The holder has an L-bracket having a horizontal arm and a vertical arm that may be attached to either end of the horizontal arm depending on whether the user desires to mount the device on the left or right side of the monitor.

Hager, et at, U.S. Pat. No. Des. 237,502 shows an ornamental design for a bin for receiving fanfold punched tape on tape-using instruments.

Davis, U.S. Pat. No. Des. 316,275 claims a design for a document holder for attachment to a computer monitor. The document holder may be mounted on either the left or right vertical side of the monitor. The document is inserted in the side of the viewer so that it is visible to the user. The surface of the mounting plate is conventionally flat.

Wilcox, U.S. Pat. No. Des. 336,197 teaches a design for an accessory storage rack for attachment to a computer monitor. The rack is mounted on either the right or the left vertical side of the monitor.

The art described above clearly shows that their is a strong need for convenience storage on the millions of video monitors in use in the United States today. The prior art however, shows devices that are not generally flexible as to the type of storage and the amount of storage possible. There is a strong need for a storage system that can be fitted to any monitor configuration, that has the ability to accommodate any size storage pocket or other type of storage device, and that is easily removed and transferred to another monitor or to alternate location such as an attaché case. The present invention fulfills these needs and provides further related advantages as described in the following summary.

SUMMARY OF THE INVENTION

The present invention is a storage device for a video monitor and includes a belt extended or stretched around the top, sides and bottom of the monitor. The outfacing surface of the belt has a loose knap so that it may be engaged by a Velcro® hook type material. Two side plates are mounted by this method of fastening to the belt along the sides of the monitor. The side plates provide outfacing pockets for storing pencils, markers and even small floppy disks or other storage elements, etc. A front plate stretches across the front of the monitor cabinet, either above or below the viewing screen. The front plate is stretched between, and also attaches to the belt along opposing sides. The front plate also includes at least one pocket for conveniently holding further objects useful to a person using the monitor. The present invention teaches certain benefits in construction and use which give rise to the following objectives:

It is a primary objective of the present invention to provide a means for storing small useful objects for convenient use when seated in front of a video monitor. It is a further objective of the invention to provide such a storage means that is adaptable to any size video monitor. It is another objective to provide separate storage elements capable of being located on the monitors sides, top and front face for convenient access. It is an important objective of the present invention to provide such a storage means, such that the storage elements may be easily removed for placement in an alternate location and replaced on the monitor when desired.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention, a device for storing small objects on a video monitor. In such drawings.

DETAILED DESCRIPTION OF THE PREFERRED EMBODIMENT

Figure 2:
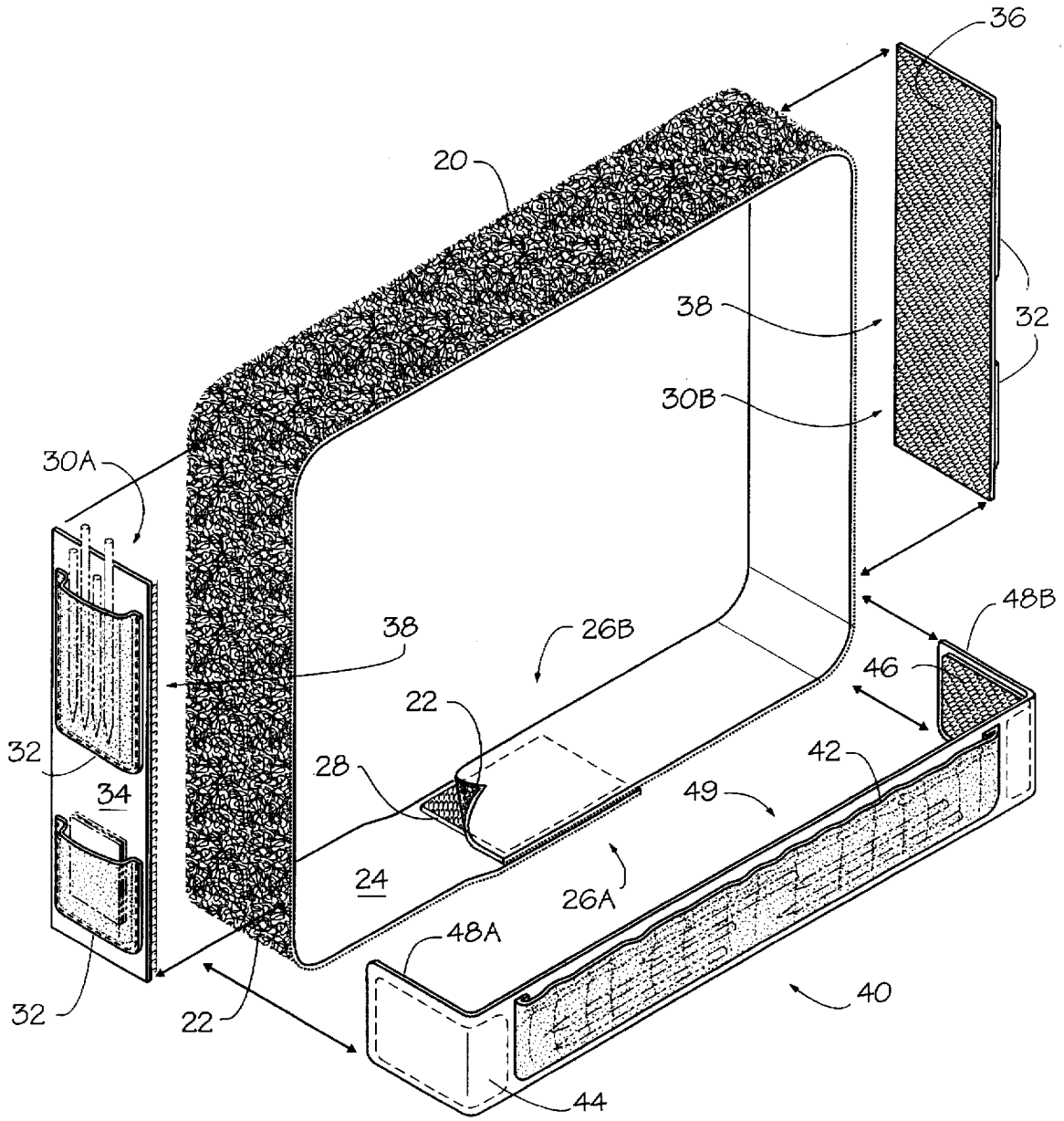
FIG. 2 is an exploded view of the invention of FIG. 1, showing further details of the invention and the method of attachment and assembly.

The above described drawing figures illustrate a device for storing small items, such as pens, pencils, marker pens, labels, floppy discs, and the like, on a video monitor 10. The device includes a monitor belt 20 preferably made of a fabric material. The belt 20 provides, on opposing sides a first 22 and a second 24 surfaces, the first 22 of the surfaces provides a generally loose knap constituting the surface of the fabric material. The knap covers the entire first surface 22, preferably, but may also cover only those portions of the first surface 22 that will be used for attaching other elements of the invention. Such a knap may constitute the loop portion of a Velcro® type material. The second of the surfaces 24 provides, on one end portion 26A of the monitor belt 20, an attachment means 28 adapted for engaging the knap of the first surface 22. This attachment means 28 is preferably a layer of the hook portion of a hook and loop type attachment device such as Velcro® surface fastener material. Thus, the belt 20 is able to be wrapped around the monitor 10 with the end portions 26A, 26B of the belt 20 tightly fastened to each other so that the belt 20 is rigidly held in place on the monitor 10. The point of fastening may be on the top 12 of the monitor 10, or alternately, at any point along the bottom surface 14 of the monitor 10, as shown in FIG. 2, whereby the sides 16, 18 of the monitor 10 are free for mounting other elements of the present invention.

The belt 10, as described above, is able to fit tightly around a wide range of monitor sizes since the fastening of the end portions 26A, 26B of the belt 20 may be completed at any selected point along the knap of the first surface 22 of the belt. Alternatively, the belt 10 might be made of an elastic material or partly of an elastic material such that it is able to be stretched to fit around a wide range of monitors 10, and in this case, the means for fastening the belt 10 around the monitor might be Velcro® fastening material, or any of the other well known fastening solutions such as clasps, hooks and eyes, or even buttons. The second surface 24 lays in contact with the top 12, left side 16, right side 18 and bottom 14 outside surfaces of the video monitor 10 with the monitor belt 20 pulled tightly around the monitor 10 and held thereon by engaging the monitor belt surface attachment means 28 with the knap of the first 22 of the monitor belt.

A pair of side plates 30A, 30B are attached to the belt 20 along the side surfaces 16, 18 of the monitor. Each of the side plates 30A, 30B provides a side plate pocket means 32 on an outfacing surface 34 of the side plate, and a side plate surface attachment means 36, such as Velcro® hook type material, on an in-facing surface 38 of the side plate. Each one of the side plate surface attachment means 36 engages with the knap of the monitor belt 10 to hold the side plates 30A and 30B rigidly attached to the sides 16, 18 respectively of the monitor.

The preferred embodiment further includes a front plate 40 providing front plate pocket means 42 on a front plate outfacing surface 44, and a front plate surface attachment means 46, such as Velcro® hook type material on two opposing end portions 48A, 48B of a front plate in-facing surface 49, the front plate in-facing surface 49, lays in contact with the front surface 19 of the monitor 10 and stretches across it, with the front plate surface attachment means 46 on the two opposing end portions 48A, 48B of the front plate in-facing surface 49 being curved around the side front edges of the monitor 10 to join with the knap of the monitor belt 10 on both sides surfaces 16, 18 of the monitor 10.

Figure 1:
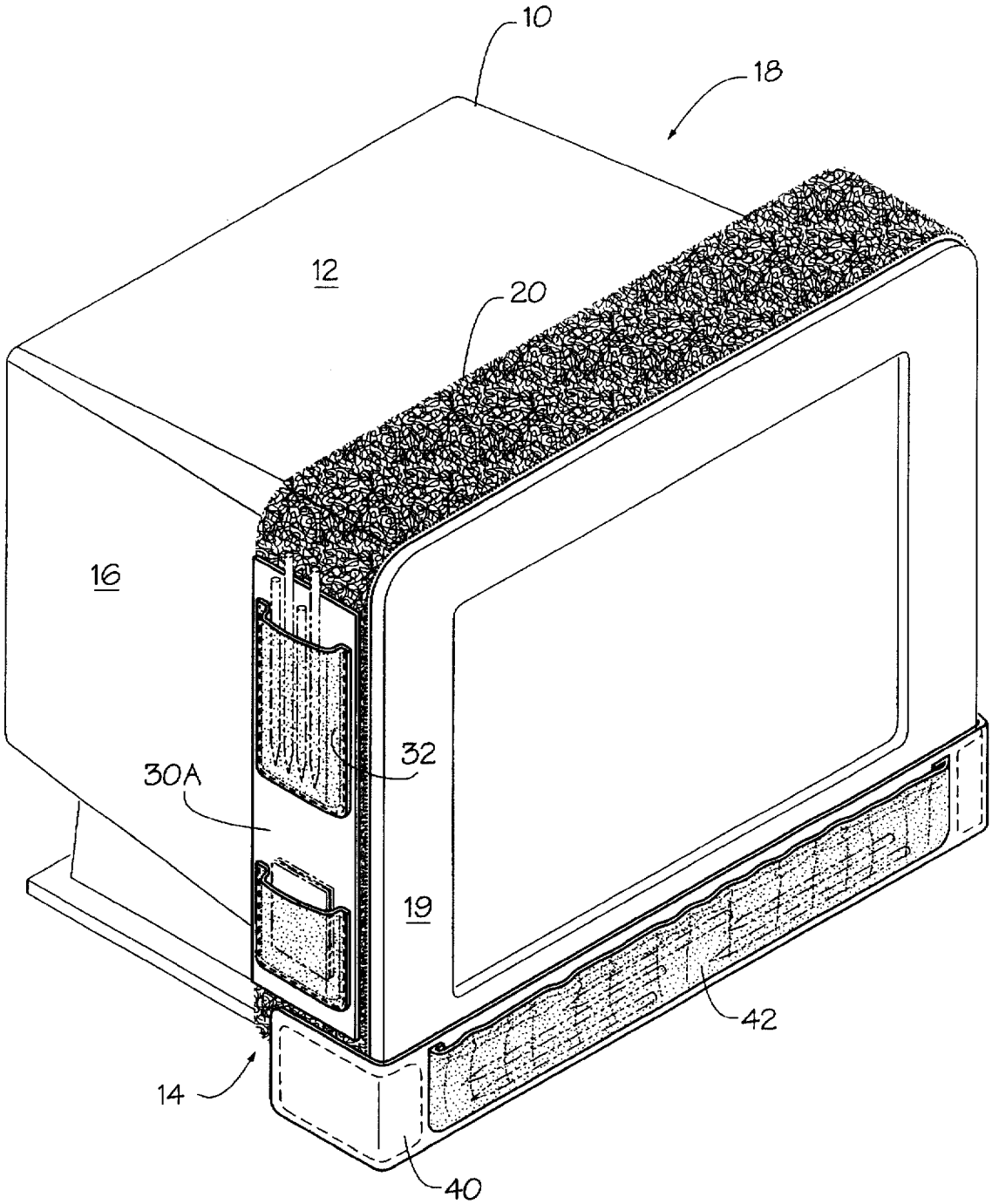
FIG. 1 is a perspective view of the preferred embodiment of the present invention, particularly showing a monitor belt with mounted side plates and a front plate.

In use, the pocket means 32 of the side plates 30A, 30B and the front plate 40 are used to hold any of the many small items found in any video work place. Therefore, the orientation, size and type of the pocket means 32 may be adapted to the particular use intended. For instance, if it is necessary to hold many pencils, at least one pocket of the pocket means 32 should be deep and tight, such as shown in the side plate 30A of FIG. 1. On the other hand, if the pocket is to be used for items that are very small, such as paper clips, pins, etc., then the pocket should have an elastic closure as is shown in the front plate 40 in FIG. 1. Pockets may be any size and conformation, and may be of a transparent material such as plastic if it is necessary to easily view the contents.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A storage device for a video monitor, the device comprising:

a monitor belt providing, on opposing sides thereof, a first and a second monitor belt surfaces, the first of the monitor belt surfaces providing a generally loose knap, the knap covering the entire first surface of the monitor belt, the second of the surfaces providing, at one end of the monitor belt, a monitor belt surface attachment means adapted for engaging the knap of the first of the monitor belt surfaces, the second of the monitor belt surfaces laying in contact with the top, left side, right side and bottom outside surfaces of a video monitor, the monitor belt pulled tightly around the monitor and held thereon by engaging the monitor belt surface attachment means with the knap of the first of the monitor belt surfaces;

a pair of side plates, each of the side plates providing side plate pocket means on an outfacing surface of the side plate, and a side plate surface attachment means on an in-facing surface of the side plate, each one of the side plate surface attachment means engaged with the knap of the monitor belt to hold the side plate generally adjacent to one of the side surfaces of the monitor.

2. The device of claim 1 further including a front plate providing front plate pocket means on a front plate outfacing surface of the front plate, and a front plate surface attachment means on two opposing end portions of a front plate in-facing surface of the front plate, the front plate in-facing surface of the front plate, in contact with the front surface of the monitor and stretched thereon by the front plate surface attachment means of the two opposing end portions of the front plate in-facing surface of the front plate, being joined to the knap of the monitor belt at each of the sides of the monitor.

3. The device of claim 1 further including a front plate providing front plate pocket means on a front plate outfacing surface of the front plate, and a front plate surface attachment means on two opposing end portions of a front plate in-facing surface of the front plate, the front plate in-facing surface of the front plate, in contact with the outside front surface of the monitor and stretched thereon by the front plate surface attachment means of the two opposing end portions of the front plate in-facing surface of the front plate, being joined to the knap of the monitor belt at each of the sides of the monitor.

4. A combination video monitor and storage device therefore, the combination comprising:

a video monitor having a top, left side, right side and front outside surfaces;

a monitor belt providing, on opposing sides thereof, a first and a second monitor belt surfaces, the first of the monitor belt surfaces providing a generally loose knap, the knap covering the entire first surface of the monitor belt, the second of the surfaces providing, at one end of the monitor belt, a monitor belt surface attachment means adapted for engaging the knap of the first of the monitor belt surfaces, the second of the monitor belt surfaces laying in contact with the top, left side, right side and bottom outside surfaces of a video monitor, the monitor belt pulled tightly around the monitor and held thereon by engaging the monitor belt surface attachment means with the knap of the first of the monitor belt surfaces;

a pair of side plates, each of the side plates providing side plate pocket means on an outfacing surface of the side plate, and a side plate surface attachment means on an in-facing surface of the side plate, each one of the side plate surface attachment means engaged with the knap of the monitor belt to hold the side plate generally adjacent to one of the side surfaces of the monitor.

* * * * *